US006513815B2

(12) United States Patent
Glass et al.

(10) Patent No.: US 6,513,815 B2
(45) Date of Patent: Feb. 4, 2003

(54) IN-LINE RACING SKATE PROPULSION DEVICE

(75) Inventors: Douglas Glass, Westminster, CA (US); Ty Bennett Daughtridge, Vinton, VA (US); Albert Merrell Kaiser, Salem, VA (US)

(73) Assignee: Verducci USA LLC, Warminster, CA (US)

( * ) Notice: Subject to any disclaimer, the term of this patent is extended or adjusted under 35 U.S.C. 154(b) by 0 days.

(21) Appl. No.: 09/742,952

(22) Filed: Dec. 21, 2000

(65) Prior Publication Data

US 2002/0008359 A1 Jan. 24, 2002

Related U.S. Application Data

(63) Continuation-in-part of application No. 09/618,470, filed on Jul. 18, 2000, now abandoned.

(51) Int. Cl.[7] ..... A63C 17/06
(52) U.S. Cl. ..... 280/11.224; 280/11.225
(58) Field of Search ..... 280/11.12, 11.14, 280/11.15, 11.19, 11.221, 11.223, 11.224, 11.225, 11.231, 11.233, 11.27, 11.28, 842

(56) References Cited

U.S. PATENT DOCUMENTS 893,341 A * 7/1908 Martinsen ..... 280/11.225
4,351,538 A * 9/1982 Berta ..... 280/11.28
5,582,418 A * 12/1996 Closser ..... 280/11.22
RE35,993 E * 12/1998 Gierveld ..... 280/11.231
6,007,075 A * 12/1999 Shum ..... 280/11.12
6,056,299 A * 5/2000 Soo ..... 280/11.27
6,082,744 A * 7/2000 Allinger et al. ..... 280/11.12
6,113,111 A * 9/2000 Gierveld et al. ..... 280/11.15
6,152,458 A * 11/2000 Edauw et al. ..... 280/11.14

FOREIGN PATENT DOCUMENTS

DE 25 27 611 A1 * 12/1976 ..... 280/842
EP 0 192 312 A2 * 8/1986 ..... A63C/1/28
NL 8602-796 A * 7/1988 ..... 280/11.14

* cited by examiner

*Primary Examiner*—Frank Vanaman
(74) *Attorney, Agent, or Firm*—Cozen O'Connor; Michael B. Fein; Brian L. Belles

(57) ABSTRACT

An in-line roller skate propulsion device comprising a lever and a wheel frame having a top, a bottom, a plurality of wheel axle holes near the bottom, a pivot connection near the top for pivotally connecting the lever to the wheel frame, and a hole and shaft combination for connecting a resilient member. The lever's pivot connection is located forward of the center of the lever. As the lever rotates around its pivotal connection to the wheel frame, the resilient member is stretched. Upon release of the rotating force, the resilient member returns the lever to a point of contact with the wheel frame or a stopping piece attached thereto. This action allows a skater to achieve greater speeds than with regular in-line roller skates while exerting the same amount of energy.

20 Claims, 8 Drawing Sheets

IN-LINE RACING SKATE PROPULSION DEVICE

CROSS REFERENCE TO RELATED APPLICATION

This application is a continuation in part of Ser. No. 09/618,470 filed Jul. 18, 2000, now abandoned.

BACKGROUND OF THE INVENTION

1. Field of the Invention

This invention relates to the field of in-line roller skates.

2. Description of the Prior Art

In-line roller skating is an established and very popular recreational activity for the general population. In addition to recreational skating, another type of in-line skating called "speed skating" has been gaining popularity over the last couple of years. Within the general area of "speed skating," there are different levels at which a person can participate and compete.

These varying styles and levels of competition of in-line roller skating have produced a need for different classes of in-line roller skates. One class of in-line roller skates is used for recreational skating, another class is used for less competitive speed skating competitions, and even another class is used for Olympic-style speed skating competitions. These different classes of in-line roller skates are designed to address the different skating needs of their particular users.

The class of in-line roller skates which are used for the Olympic-style competitions are referred to as in-line racing skates. Due to the extremely competitive nature of Olympic-style speed skating, an in-line racing skate that will maximize a skater's speed is desired.

To date, no one has been able to successfully demonstrate an in-line racing skate with a propulsive action that can be used successfully in Olympic-style racing competitions. Known prior art in the area of in-line roller skates that either purposely or inherently contain a propulsive element are U.S. Pat. No. 5,503,413; U.S. Pat. No. 5,586,774; U.S. Pat. No. 5,704,621; and U.S. Pat. No. 5,823,543. While these prior art devices contain a propulsive element, they also contain a shock-absorbing element. In fact, it is this shock absorbing feature that is the key feature of many of the prior art devices.

Despite the fact that the prior art devices contain a propulsive element, none of these devices are suitable for Olympic-style speed skating races. In order to successfully absorb shocks, the resilient means of the prior art devices, be it springs or otherwise, are capable of experiencing both compression and tension forces. When the resilient means of the prior art devices are allowed to be compressed, they absorb energy of the skater and result in both an ineffective "push off" and an ineffective propulsive effect. The current invention remedies these deficiencies.

Furthermore, in recent years, clap skates have become popular in the field of racing on ice skates. However, due to the differences in the physics of ice skating and inline skating, ice clap skate technology has not been applied successfully to the field of inline roller skates.

Raps, a Netherlands company, has proposed an in-line clap skate frame but the frame has a number of deficiencies. Due to these deficiencies, the Raps skate frame is not very effective for the Olympic-style racing competitions. As a result of these deficiencies, the Raps skate has not found significant commercial success in the market.

SUMMARY OF THE INVENTION

It is therefore an object of the present invention to provide a new frame for in-line racing skates which allows higher speeds with lower effort on the part of the skater.

It is another object of the present invention to provide a new in-line racing skate frame which will more fully capture the push off energy exerted by a skater and properly transfer this energy to maximize the speed of the skater.

It is yet another object of the present invention to provide a new in-line racing skate frame that can successfully capture and apply the advantages that are currently experienced by ice clap skates.

An even further object of the present invention is to provide a new in-line racing skate frame which may be easily and efficiently manufactured.

Still another object of the present invention is to provide a new in-line racing skate frame that is durable and of reliable construction.

Still yet another object of the present invention is to provide a new in-line racing skate frame which will be successful both commercially and in Olympic-style in-line racing competitions.

Yet another object of the present invention is to provide a new in-line racing skate frame which includes a resilient means that will act as an effective propulsion element without unnecessarily absorbing any of the skater's input energy.

These objects, and others which will become apparent from the following detailed description, are achieved by the present invention which comprises in one aspect a wheel frame, a lever, and a resilient member.

The wheel frame can be a one piece or two piece frame. When the frame is two piece, it has a left side plate and a right side plate; each of the left and right side plates having a top, a bottom, a plurality of wheel axle holes near the bottom, and a pivot means near the top for pivotally connecting a lever to the wheel frame; the wheel frame also having a means for connecting a resilient member. When the frame is one-piece, it can be either extruded or machined.

The lever has a pivot means for pivotally connecting the lever to the wheel frame located forward of the center of the lever, a means for connecting a resilient member to the lever, and a means for connecting a boot to the lever. Preferably the pivot is located at a point under where the sole of the boot would fit rather than where the toe of the boot would fit as is the case with prior devices. The lever has a zero position with respect to the frame which is the position where the skater's weight is not forward of the pivot point, i.e., the position where the resiliant member tends to maintain the lever. The lever is preferably constructed so as to have a rear section which is angled down, also known as a counter-rotated lever.

The resilient member is always under tension so as to maintain the device in the zero position or return the device from a rotated position to the zero position. The preferred resilient member is a metal coil spring, but can also be a rubber member. Additionally, the pivot means of the wheel frame pivotally connects the lever to the wheel frame in a fixed translation position with respect to the wheel frame.

Preferably, the wheel frame's means for connecting the resilient member is more rearward of the device than the lever's means for connecting the resilient member when the device is in the zero position; the lever's means for connecting the resilient member is near the center of the lever. The direction of the resilient member on an upward angle toward the front of the device, connected to the lever at the top, gives superior performance versus prior spring configurations which were either vertical or on a downward angle toward the front.

The lever preferably has a left and right means for connecting a resilient member. In the two piece frame embodiments, the left and right side plates of the wheel frame may each have a means for connecting a resilient member or there may be a single central means for connecting the resilient member. In either embodiment, the resilient members are connected directly to the lever's means for connecting a resilient member.

The resilient member preferably comprises a left and right side resilient member, for example a left and right coil spring.

The lever's left and right side means for connecting a resilient member can be a single shaft that is capable of having coil springs attached thereto, The left and right side plate's means for connecting the resilient members can be holes through which a shaft that is capable of having coil springs attached thereto extends.

The left and right side plates' pivot means for pivotally connecting to the lever can be pivot holes. The lever's pivot means for pivotally connecting to the wheel frame are also pivot holes that are aligned with the pivot holes of the wheel frame, wherein a shaft is extended therethrough.

The device has a boot with an arch, a heel, and a ball that is connected to the lever by engagement holes. The device preferably has five wheels but can have as few as three and as many as seven. The wheels are mounted to the wheel frame by wheel axles that extend through the wheel axle holes of the frame. In the zero position, the lever preferably contacts an upwardly extended surface of the wheel frame, or a stopping means attached to the frame.

DETAILED DESCRIPTION OF THE INVENTION AND THE PREFERRED EMBODIMENTS

The figures depict a preferred embodiment of the present invention for purposes of illustration only. One skilled in the art will readily recognize from the following discussion that alternative embodiments of the structures and methods illustrated herein may be employed without departing from the principles of the invention described herein.

Figure 1:
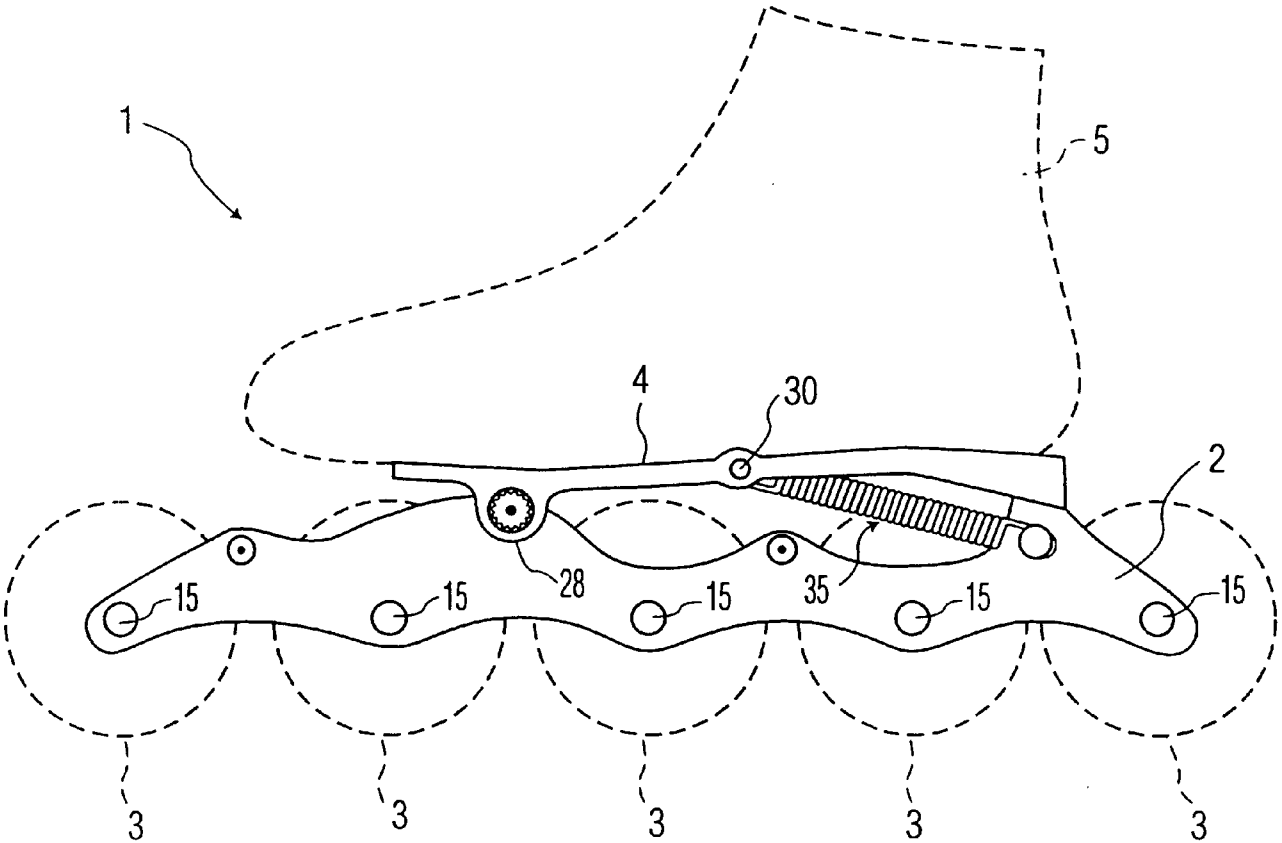
FIG. 1 is a side elevational view of the invention, an in-line racing skate propulsion device with a coil spring as the resilient member, and a boot and wheels shown in phantom.
Figure 7:
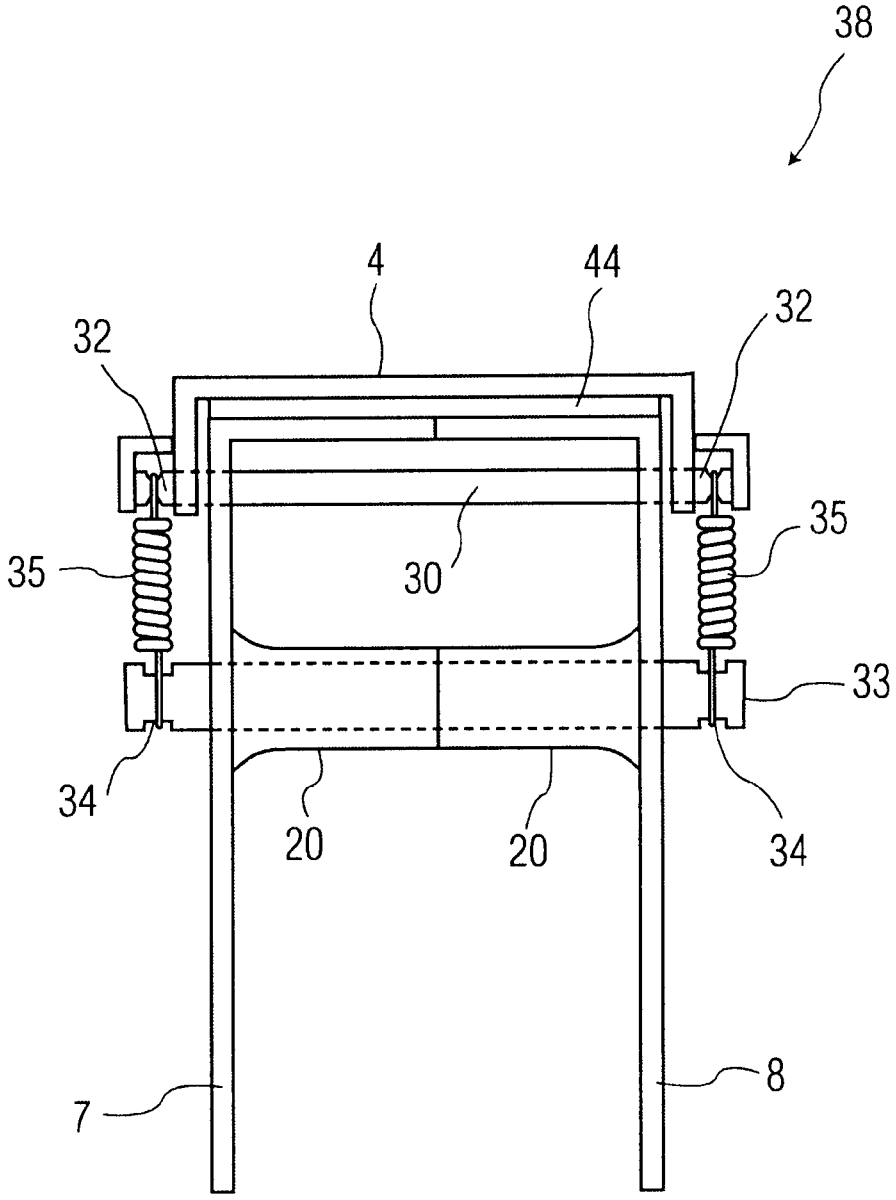
FIG. 7 is a rear view of the in-line racing skate propulsion device.
Figure 8:
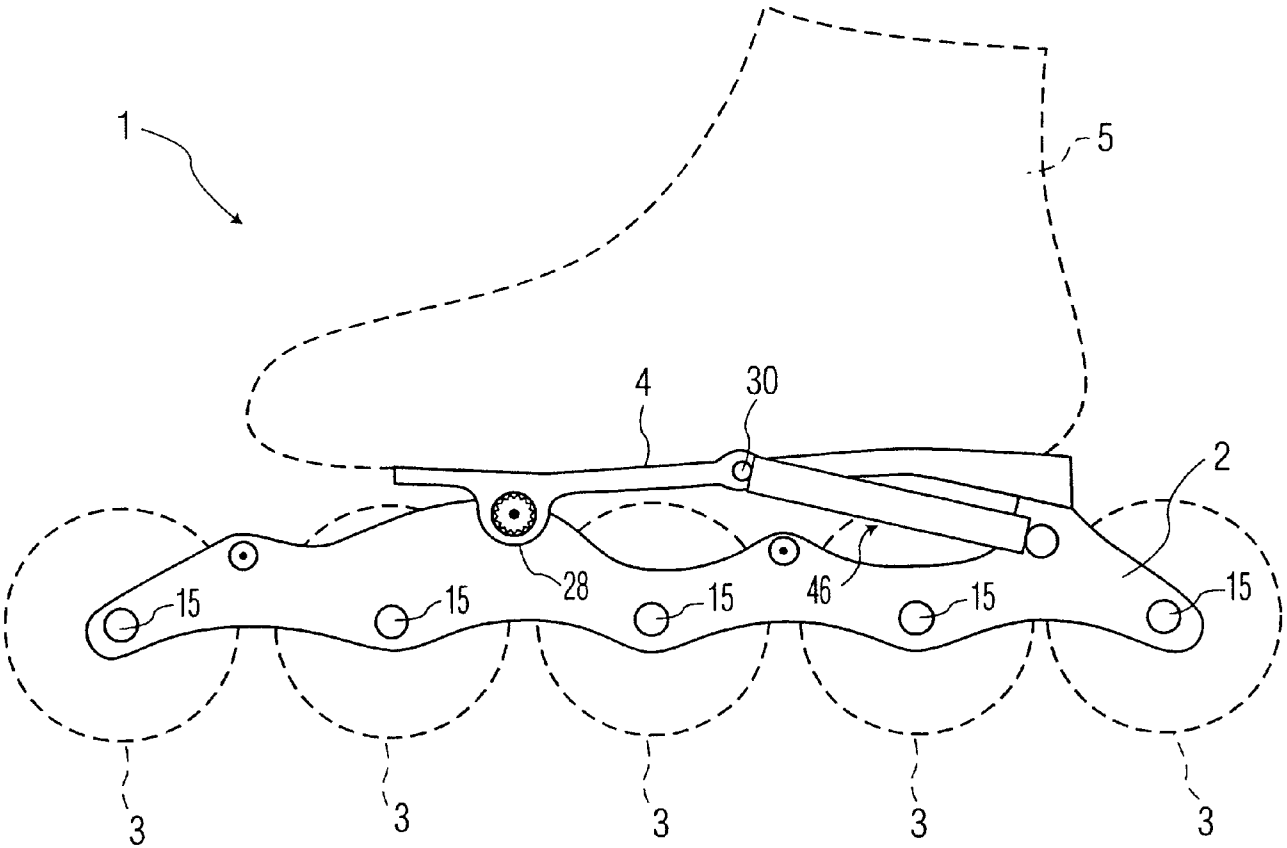
FIG 8. is a side elevational view of the invention, an in-line racing skate propulsion device with a resilient member, and a boot and wheels shown in phantom.

FIG. 8 illustrates an in-line racing skate 1 which includes a wheel frame 2 mounting a plurality of wheels 3 for rotation within a common plane. Skate 1 also includes a lever 4 and a boot 5, wherein the boot 5 is attached to the lever 4. Skate 1 further includes a resilient member 46 which can be a coil spring, a leaf spring, or a rubber band. FIG. 1 illustrates the resilient member 46 as a coil spring 35, used to connect the lever 4 to the wheel frame 2. The illustrated embodiment uses two coil spring 35 (FIG. 7).

Figure 2:
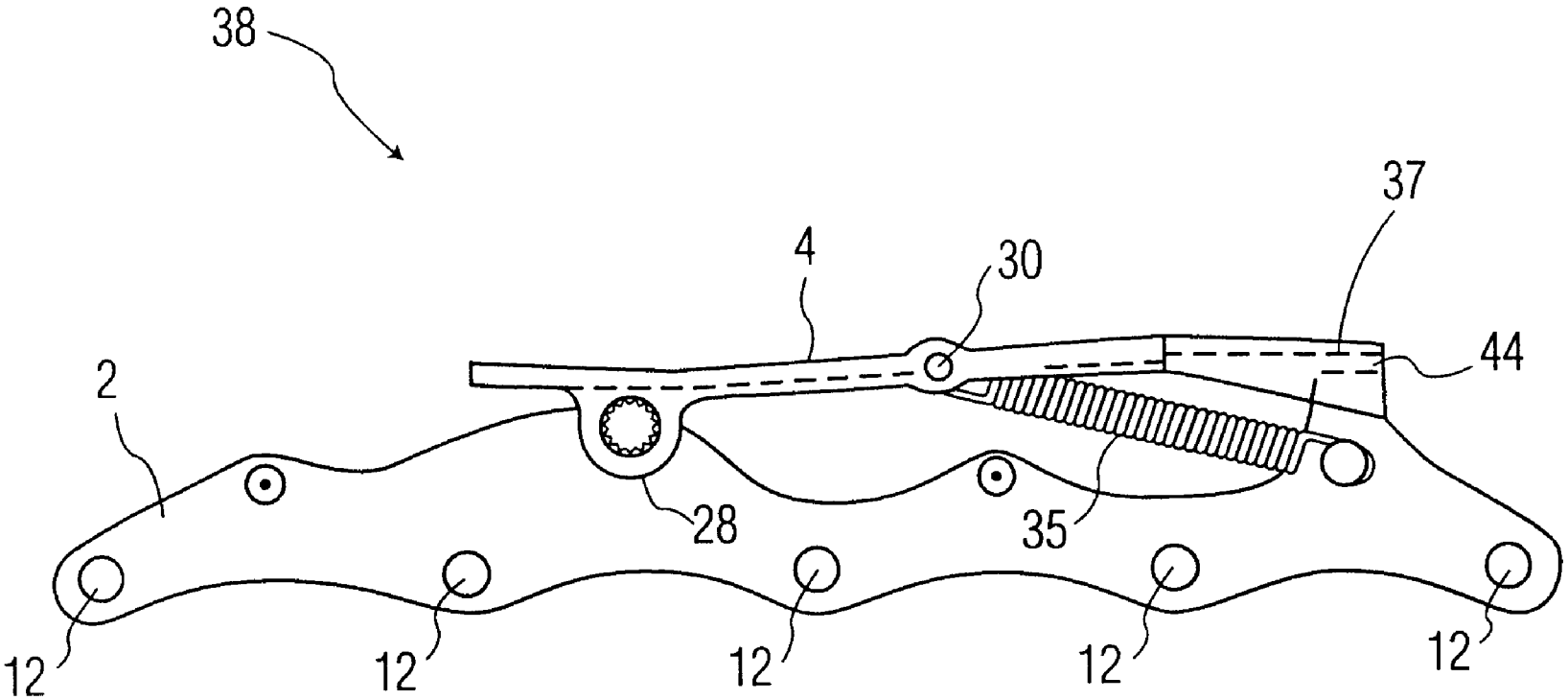
FIG. 2 is a side elevational view of the in-line racing skate propulsion device in the zero position.
Figure 3:
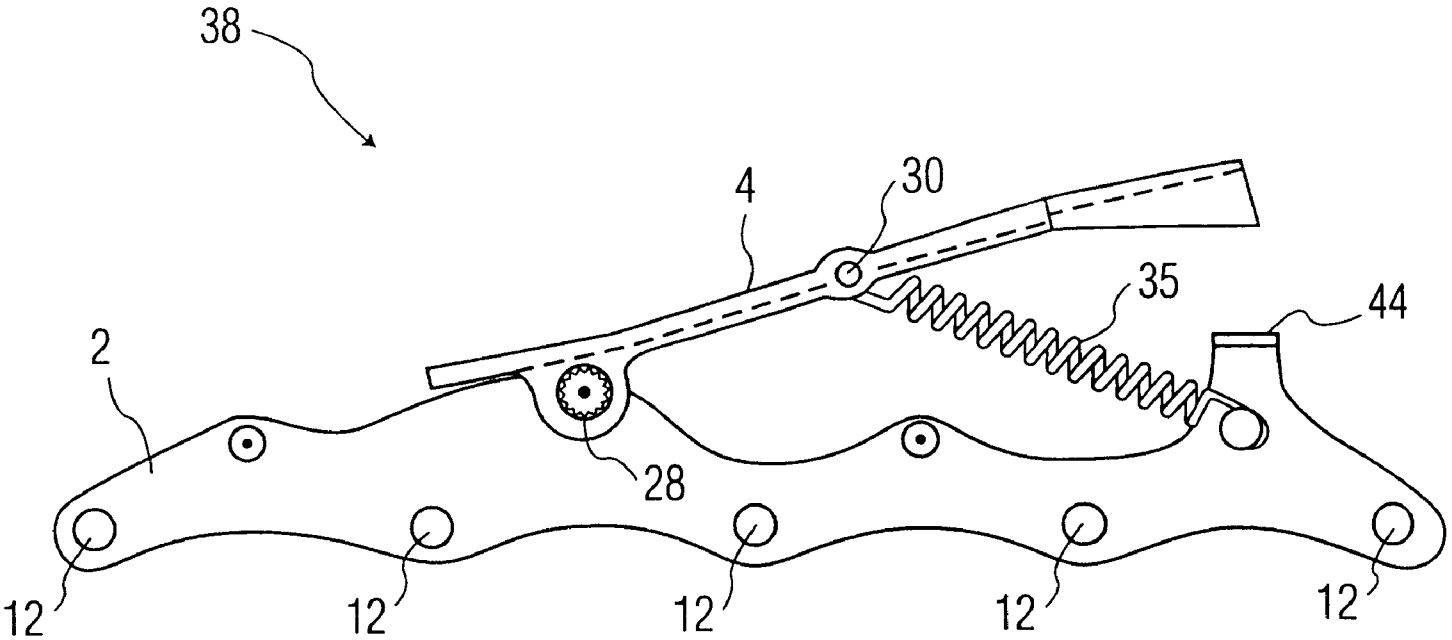
FIG. 3 is a side elevational view of the in-line racing skate propulsion device in a rotated position.

Referring to FIG. 2, the device 38 is illustrated in the zero position. The springs 35 are aligned on an upward angle from back to front. In FIG. 3, the device 38 is in a rotated position wherein the springs are under increased tension caused by the forward weight of the skater on the boot. The coil springs 35 are always under tension so as to maintain the device 38 in the zero position and to return it to the zero position from a rotated position.

Figure 4:
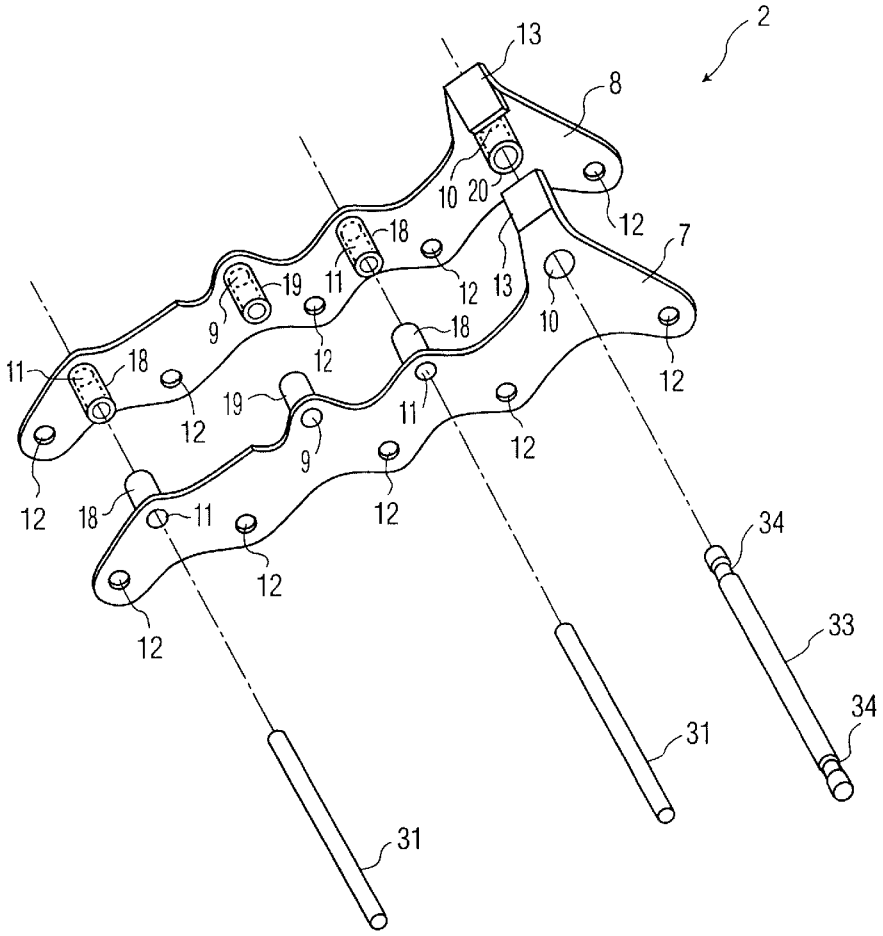
FIG. 4 is an exploded view of the wheel frame of the in-line racing skate propulsion device showing its frame bearing and rear pivot shaft elements.

Referring now to FIG. 4, the wheel frame 2 has a left side plate 7 and a right side plate 8 that are symmetric and parallel to one another, each plate 7, 8 having a front pivot hole 9, a rear pivot hole 10, two frame support holes 11, a plurality of wheel axle holes 12, and an upwardly extended contact surface 13. Each plate 7,8 also has two inwardly extended frame bearing tubes 18, an inwardly extended front pivot tube 19, and an inwardly extended rear pivot tube 20.

Figure 6:
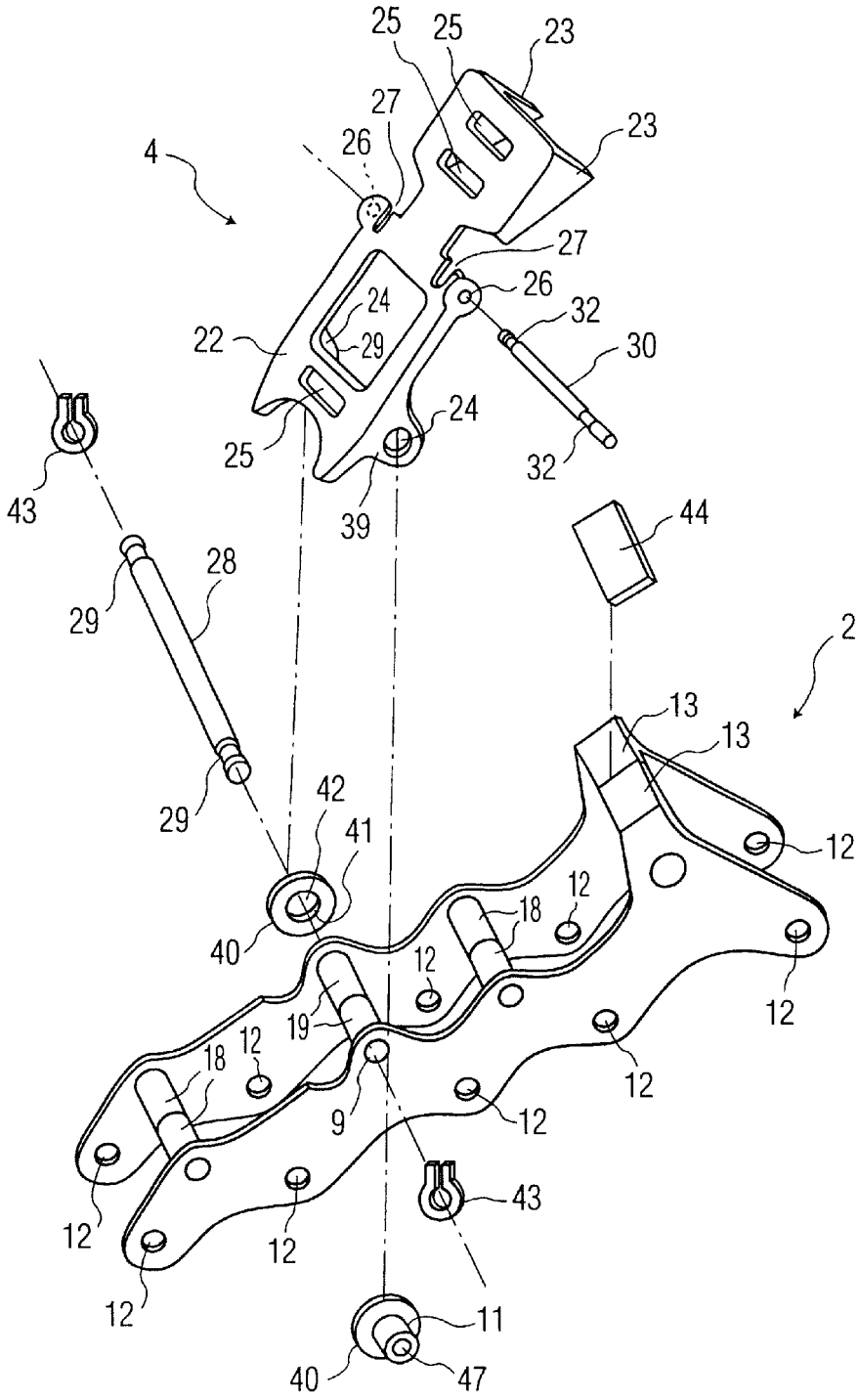
FIG. 6 is an exploded view of the wheel frame and lever of the in-line racing skate propulsion device showing its pivotal connection elements.

In assembling the wheel frame 2, the left 7 and right 8 side plates are aligned so the upwardly extended contact surface 13, the tubes 18–20, and the holes 9–12 of each plate 7, 8 are aligned with the corresponding tube 18–20, hole 9–12, or contact surface 13 on the opposite plate 7, 8. The left 7 and right 8 plates are then butted together until the tubes 18–20 and contact surface 13 of each plate 7, 8 are in contact with the corresponding tube 18–20 or contact surface 13 of the opposite plate 7, 8 (FIG. 6). A frame bearing shaft 31 is then extended through each of the frame bearing holes 11 and frame bearing tubes 18 of the left 7 and right 8 plates until it is approximately flush with the planes formed by left 7 and right 8 side plates. This holds the left 7 and right 8 side plates together and helps provide stability to the wheel frame 2.

Figure 5:
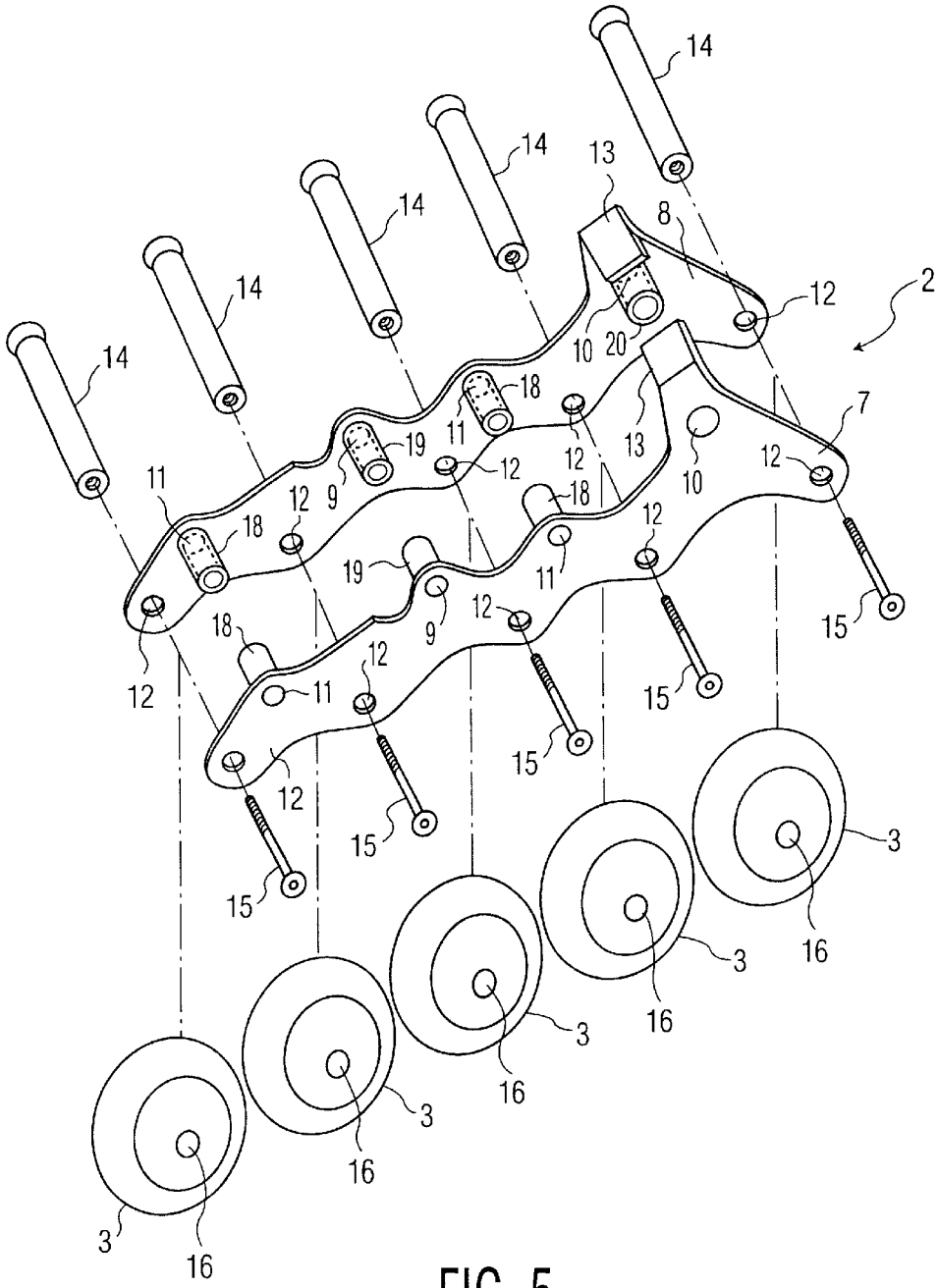
FIG. 5 is an exploded view of the wheel frame of the in-line racing skate propulsion device showing its wheel connection elements.

Referring now to FIG. 5, the plurality of wheels 3 are each mounted to the wheel frame 2 by the following method. The bore 16 of each wheel 3 is aligned with its respective wheel axle hole 12 on the left 7 and right 8 side plates. An axle thread insert 14 is extended therethrough. An axle bolt 15 is then extended through the wheel axle hole 12 of the left side plate 7 and threadedly engaged to a corresponding axle thread insert 14. This secures each wheel 3 to its proper place on the wheel frame 2 (FIG. 1).

FIG. 6 shows the lever 4, and how it is pivotally connected to the wheel frame 2. The lever 4 has a foot plate 22, vertical guide plates 23, and vertical side plate 39. In the illustrated, preferred embodiment, the lever has a rear, counter-rotated section 45 which is adapted to fit the heel of the boot 5 so that the heel is lower and the boot is on a slight rear angle. Each vertical side plate 39 has a pivot hole 24 and spring shaft hole 26 that is aligned with the corresponding hole 24, 26 of the opposite vertical side plate 39. The foot plate 22 has three attachment slots 25 (shown as two heel engagement holes and a ball engagement hole) for connecting a boot 5, and two spring connection spaces 27 cut out of its surface. The boot 5 is connected to the lever 4 by extending bolts through the attachment slots 25 and threadily engaging the bottom of the boot 5.

In pivotally connecting the lever 4 to the wheel frame 2, two washers 40 with an extended tube 41 and a washer hole 42 are used. The extended tube 41 of each washer 41 is fitted into the corresponding pivot hole 24 of the lever 4 so the pivot hole 24 rests on the extended tube 41 of the washer 40. The washer holes 42 are then aligned with the front pivot holes 9 of the left 7 and right 8 side plates of the wheel frame 2 and a front pivot shaft 28 with grooves 29 is extended therethrough. The front pivot shaft 28 is extended therethrough until both of its grooves 29 extend beyond the corresponding washer's 40 extended tube 41. A U-shaped locking pin 43 is then fastened to the front pivot shaft 28 in each of its grooves 29. This holds the front pivot shaft 28 in its proper place while stabilizing the pivotal connection.

Furthermore, a spring shaft 30 is extended through the spring shaft holes 26 of the vertical side plates 39 of the lever 4 until the spring shaft 30 is positioned so that its grooves 32 are directly below a corresponding spring connection space 27 of the foot plate 22. Similarly, a rear pivot shaft 33 is extended through the resilient means connection holes 10 and the inwardly extended resilient means connection tubes 20 of the left 7 and right 8 side plates (FIG. 4). The rear pivot shaft 33 is positioned so that its grooves 34 are protruding from the planes formed by the left 7 and right 8 side plates (FIG. 7).

Referring now to FIG. 7, the resilient member 46 of the device 38 is two coil springs 35 on the outside of the frame 7, 8. We have found it to be advantageous to have the resiliant members on the outside of the frame rather than on the inside, as is used in prior art devices. The resiliant members can be rubber bands or hydraulic shocks rather than metal springs as are illustrated in FIG. 7. One end of each coil spring 35 is connected to the grooved section 34 of the rear pivot shaft 33, while the other end is attached to the corresponding grooved section 32 of the lever's 4 spring shaft 30. The frame can be a one piece, extruded or machined rather than the two piece frame illustrated in FIG. 7 as members 7 and 8.

Referring to FIG. 3, the lever 4 can be rotated against the force of the coil springs 35 about the front pivot shaft 28, causing the coil springs 35 to be more inclined and under increased tension. The tension of the coil springs 35 tends to return the lever 4 to a plane of contact 37 with a stopping piece 44 (FIG. 2) that is attached to the upwardly extended contact surfaces 13 of the left 7 and right 8 side plates of the wheel frame 2 (FIG. 6). When the lever 4 is in this contacted position, the device 38 is said to be in the zero position (FIG. 4). Even when in the zero position, the coils springs 35 are under tension and are still at an incline.

The foregoing discussion discloses and describes merely exemplary embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

What is claimed is:

1. An in-line roller skate propulsion device comprising:

a wheel frame having a left side plate and a right side plate; each of the left and right side plates having a top, a bottom, a plurality of wheel axle holes near the bottom, and a pivot means near the top for pivotally connecting a lever to the wheel frame; the wheel frame also having a means for connecting a resilient member;

a lever having a pivot means for pivotally connecting the lever to the wheel frame located forward of the center of the lever, a means for connecting a resilient member to the lever, and a means for connecting a boot to the lever;

wherein the pivot means of the left and right side plates pivotally connect the lever to the wheel frame in a fixed translation position with respect to the wheel frame;

a resilient member;

the device having a zero position; the resilient member always being under tension so as to maintain the device in the zero position or return the device from a rotated position to the zero position; and wherein the wheel frame's means for connecting the resilient member is more rearward of the device than the lever's means for connecting the resilient member when the device is in the zero position.

2. The in-line roller skate propulsion device of claim 1, wherein the lever's means for connecting the resilient member is near the center of the lever.

3. The in-line roller skate propulsion device of claim 1, wherein the resilient member is a coil spring, a leaf spring, or a rubber band.

4. The in-line roller skate propulsion device of claim 1, wherein the zero position is determined by the contacting of the lever, or an extension thereof, with upwardly extended surfaces of the left and right side plates of the wheel frame, or a stopping means attached to the upwardly extended surfaces of the left and right side plates of the wheel frame.

5. The-in line roller skate propulsion device of claim 1, wherein the lever's means for connecting a resilient member is a shaft.

6. The in-line roller skate propulsion device of claim 1, wherein the wheel frame's means for connecting a resilient member comprises holes through which a shaft extends.

7. The in-line roller skate propulsion device of claim 1, wherein the left and right side plate's pivot means for pivotally connecting to the lever are pivot holes; wherein the lever's pivot means for pivotally connecting to the wheel frame are holes that approximately match the pivot holes of the left and right side plates, through which a shaft extends.

8. The in-line roller skate propulsion device of claim 1, wherein a boot, having a heel, an arch, and a ball, is fastened to the lever, wherein the lever has a front, a center, and a rear; the lever's boot connection means having a ball engagement hole near the front and a two heel engagement holes near the rear.

9. The in-line roller skate propulsion device of claim 1, wherein a plurality of wheels are mounted to the device by wheel axles that extend through the plurality of wheel axle holes.

10. The in-line roller skate propulsion device of claim 9, wherein the number of wheels mounted to the device and the number of wheel axle holes is five.

11. The in-line roller skate propulsion device of claim 1, wherein a boot is attached to the lever by a ball engagement hole and two heel engagement holes; five wheels are mounted to the device by wheel axles that extend through the wheel axle holes; the lever's pivot means for connecting to the wheel frame are holes that match up with pivot holes of the left and right side plates, the lever and wheel frame pivotally connected by means of a shaft extending through the holes of the lever and the pivot holes of the left and right side plates; the resilient member comprises left and right coil springs, the lever's means for connecting the resilient members is a shaft located near the center of the lever; and the right and left side plates' means for connecting the resilient members are pivot holes through which a shaft extends.

12. An in-line roller skate propulsion device comprising:

a wheel frame having a left side plate and a right side plate; each of the left and right side plates having a top, a bottom, a plurality of wheel axle holes near the bottom, and a pivot means near the top for pivotally connecting a lever to the wheel frame; the wheel frame also having a means for connecting two resilient members;

a lever having a pivot means for pivotally connecting the lever to the wheel frame located forward of the center of the lever, means for connecting two resilient members, and means for connecting a boot to the lever;

wherein the pivot means of the left and right side plates pivotally connect the lever to the wheel frame in a fixed translation position with respect to the wheel frame;

two resilient members connected directly to the lever's means for connecting two resilient members; and the device having a zero position; the resilient members always being under tension so as to maintain the device in the zero position or return the device from a rotated position to the zero position.

13. The in-line roller skate propulsion device of claim 12 comprising a left and right side resilient member, wherein the left and right side resilient members are coil springs, leaf springs, or rubber bands.

14. An in-line roller skate propulsion device comprising:

a wheel frame having a top, a bottom, a plurality of wheel axle holes near the bottom, a pivot means near the top for pivotally connecting a lever to the wheel frame, and means for connecting a resilient member;

a lever adapted to receive a boot which has a heel, toe, and ball, the lever having a pivot means for pivotally connecting the lever to the wheel frame located forward of the center of the lever, a means for connecting a resilient member to the lever, and a means for connecting a boot to the lever;

wherein the pivot means of the wheel frame pivotally connect the lever to the wheel frame in a fixed translation position with respect to the wheel frame;

a resilient member;

the device having a zero position; the resilient member always being under tension so as to maintain the device in the zero position or return the device from a rotated position to the zero position; and wherein the wheel frame's means for connecting the resilient member is more rearward of the device than the lever's means for connecting the resilient member when the device is in the zero position.

15. Device of claim 14 wherein the resilient member comprises one or two coil springs.

16. Device of claim 14 wherein the lever is counter-rotated so as to have a rear section which is angled down, the rear section adapted to receive the heel of the boot.

17. Device of claim 14 wherein the pivot is located so that when the lever is engaged with a boot, the pivot means is under the sole of the boot.

18. Device of claim 14 wherein the frame is one piece and is extruded or machined.

19. An in-line roller skate propulsion device comprising:

a wheel frame having a top, a bottom, a plurality of wheel axle holes near the bottom, a pivot means near the top for pivotally connecting a lever to the wheel frame, and means for connecting two resilient members;

a lever adapted to receive a boot which has a heel, toe, and ball, the lever having a pivot means for pivotally connecting the lever to the wheel frame located forward of the center of the lever, a means for connecting two resilient members to the lever, and a means for connecting a boot to the lever;

wherein the pivot means of the wheel frame pivotally connects the lever to the wheel frame in a fixed translation position with respect to the wheel frame;

two resilient members connected directly to the lever's means for connecting two resilient members; and the device having a zero position; the resilient member always being under tension so as to maintain the device in the zero position or return the device from a rotated position to the zero position.

20. The in-line roller skate propulsion device of claim 19 comprising a left and right side resilient member, wherein the left and right side resilient members are coil springs, leaf springs, or rubber bands.

* * * * *